US008681057B2

(12) United States Patent
Jung et al.

(10) Patent No.: US 8,681,057 B2
(45) Date of Patent: Mar. 25, 2014

(54) MOBILE TERMINAL AND METHOD FOR FABRICATING ANTENNA OF MOBILE TERMINAL

(75) Inventors: Byungwoon Jung, Seoul (KR); Ansun Hyun, Seoul (KR); Changwon Yun, Gwangmyeong (KR); Yochuol Ho, Seongnam (KR); Yongseok Park, Gumi (KR); Gihoon Tho, Seoul (KR); Youngtae Lim, Anyang (KR); Hanki Kim, Suwon (KR); Euntaek Jeoung, Anyang (KR)

(73) Assignee: LG Electronics Inc., Seoul (KR)

( * ) Notice: Subject to any disclaimer, the term of this patent is extended or adjusted under 35 U.S.C. 154(b) by 305 days.

(21) Appl. No.: 13/071,423

(22) Filed: Mar. 24, 2011

(65) Prior Publication Data

US 2011/0298670 A1 Dec. 8, 2011

(30) Foreign Application Priority Data

Jun. 4, 2010 (KR) ..... 10-2010-0053060

(51) Int. Cl.
*H01Q 1/24* (2006.01)

(52) U.S. Cl.
USPC ..... 343/702; 343/841; 438/565; 455/566

(58) Field of Classification Search
USPC ..... 343/702, 841; 438/586; 455/566
See application file for complete search history.

(56) References Cited

U.S. PATENT DOCUMENTS

| | | | | |
|---|---|---|---|---|
| 8,136,735 | B2 * | 3/2012 | Arai et al. | 235/492 |
| 2003/0114120 | A1 | 6/2003 | Kwong et al. | |
| 2004/0183788 | A1 | 9/2004 | Kurashima et al. | |
| 2006/0009251 | A1 * | 1/2006 | Noda et al. | 455/550.1 |
| 2007/0216583 | A1 * | 9/2007 | Hou | 343/702 |
| 2007/0226994 | A1 | 10/2007 | Wollach et al. | |
| 2007/0287503 | A1 * | 12/2007 | Ying et al. | 455/566 |
| 2009/0063340 | A1 * | 3/2009 | Chiang | 705/41 |
| 2009/0166616 | A1 * | 7/2009 | Uchiyama | 257/43 |
| 2010/0279739 | A1 * | 11/2010 | Lin et al. | 455/566 |
| 2012/0083109 | A1 * | 4/2012 | Utsuno et al. | 438/586 |

FOREIGN PATENT DOCUMENTS

| | | |
|---|---|---|
| CN | 201698380 | 1/2011 |
| FR | 2405561 | 5/1979 |
| GB | 2471161 | 12/2010 |
| JP | 2006048166 | 2/2006 |
| KR | 1020100062539 | 6/2010 |

* cited by examiner

*Primary Examiner* — Allyson Trail
(74) *Attorney, Agent, or Firm* — Lee, Hong, Degerman, Kang & Waimey

(57) ABSTRACT

A mobile terminal includes a body having a user input unit for receiving a control command; an antenna unit mounted on the body to transmit and receive a radio signal; and a circuit board connected to the antenna unit to process the radio signal, wherein the antenna unit includes: a base film made of a light-transmissive material; a first conductive oxide film formed on one surface of the base film; a metal conductive part laminated on the first conductive oxide film and forming an antenna pattern corresponding to the radio signal; and a second conductive oxide film configured to cover the metal conductive part.

17 Claims, 12 Drawing Sheets

MOBILE TERMINAL AND METHOD FOR FABRICATING ANTENNA OF MOBILE TERMINAL

CROSS REFERENCE TO RELATED APPLICATIONS

The present application claims the benefit of earlier filing date and right of priority to Korean Application No. 10-2010-0053060 filed on Jun. 4, 2010, the entire contents of which is hereby incorporated by reference in its entirety.

BACKGROUND OF THE INVENTION

1. Field of the Invention

The present invention relates to a mobile terminal having an antenna and a method for fabricating a light-transmissive antenna.

2. Description of the Related Art

In general, terminals may be divided into a mobile terminal and stationary terminal according to whether or not terminals are movable. In addition, mobile terminals may be divided into a handheld terminal and a vehicle mount terminal according to whether or not users can directly carry it around.

As such functions become more diversified, the mobile terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

Efforts are ongoing to support and increase the functionality of mobile terminals. Such efforts include software and hardware improvements, as well as changes and improvements in the structural components which form the mobile terminal.

Also, as mobile terminals are considered personal portable objects that can express individuals' personality, various designs are required. Such forms in terms of designs may include a structural alteration and modification allowing users to conveniently use mobile terminal.

An antenna and a touch sensor may be considered as one of the structural alteration and modification.

SUMMARY OF THE INVENTION

Accordingly, one object of the present invention is to provide a mobile terminal having an input method which is different from the conventional one.

Another object of the present invention is to provide a mobile terminal having a light-transmissive antenna and a method for fabricating a light-transmissive antenna.

To achieve the above objects, there is provided a mobile terminal including a body having a user input unit for receiving a control command; an antenna unit mounted on the body to transmit and receive a radio signal; and a circuit board connected to the antenna unit to process the radio signal, wherein the antenna unit includes: a base film made of a light-transmissive material; a first conductive oxide film formed on one surface of the base film; a metal conductive part laminated on the first conductive oxide film and forming an antenna pattern corresponding to the radio signal; and a second conductive oxide film configured to cover the metal conductive part.

The metal conductive part may include: a metal conductive layer configured to cover the first conductive oxide film; and a grid layer including a plurality of lines as a metal conductor formed to cross to form a grid on a surface of the metal conductive layer.

The grid layer may be configured such that the width of each of the lines is 10 micrometers to 20 micrometers, and the distance between adjacent lines is 400 micrometers to 600 micrometers. The first and second conductive oxide film may be made of one of IZO (Zinc doped Indium Oxide), ITO (Tin doped Indium Oxide), AZO (Aluminum doped Zinc Oxide), GZO (Gallium doped Zinc Oxide), ZTO Zinc oxide), AZTO (Aluminum, Tin doped Zinc Oxide), $TiO_2$, IAZTO (Aluminum, Zinc, Tin doped Indium Oxide), IZTO (Zinc, Tin doped Indium Oxide), and $SiO_2$, and the metal conductor may be one of silver (Ag), copper (Cu), gold (Au), molybdenum (Mo), and aluminum (Al).

The antenna unit may include a plurality of first conductive oxide films, a plurality of metal conductive parts, and the second conductive oxide films which are symmetrically laminated on both surfaces of the base film in order to receive radio signals of a plurality of frequency bands. The antenna unit may include a plurality of first conductive oxide films, a plurality of metal conductive parts, and the second conductive oxide films which are sequentially laminated on one surface of the base film.

The metal conductive part may be disposed on a surface of the first oxide film, and include the metal conductor forming a grid in the interior of the antenna pattern.

The user input unit may include a touch sensor configured to detect a touch input, and the touch sensor may include at least one electrode layer forming a touch pattern on the base film in order to detect a touched point. The electrode layer may include the same materials as the first conductive oxide film, the metal conductive part, and the second conductive oxide film, which are laminated in the same order as that of the antenna unit. At least a portion of the touch pattern may form the antenna pattern.

The mobile terminal may further include: a window and a display. The window may be mounted on the body such that it is laminated with the touch sensor; and the display may display visual information and be disposed to be covered by the window.

The user input unit may include: a case of the body and a keypad pattern. The case may be made of a light-transmissive material and a touch sensor may be mounted on the case to receive a control command. The keypad pattern may be formed on the case and have numbers, characters, and symbols corresponding to the control command. The antenna unit may be disposed to overlap with the keypad pattern.

The terminal body may include first and second bodies coupled to be relatively movable between a closed configuration and an open configuration, and the user input unit may be formed on any one of the first and second bodies and covered by the other of the first and second bodies in the closed configuration.

The terminal body may have a front surface portion, a rear surface portion, and a side surface portion, the front surface portion may include a display unit displaying visual information, and the side surface portion may include the antenna unit disposed such that the antenna pattern faces in a direction crossing the front surface portion. The user input unit may be disposed on the side surface portion and include a touch sensor configured to detect a touch input, and the touch sensor may include at least one electrode for forming a touch pattern on the base film in order to detect a touched point.

The terminal body may include: a window disposed on one surface of the body case; and a window bezel made of a light-transmissive material and mounted on the case to support the window, wherein the antenna unit is mounted on the window bezel.

To achieve the above objects, there is also provided a mobile terminal including a body having a touch sensor mounted thereon to detect a touch input; an antenna unit configured to transmit and receive a radio signal and formed on the touch sensor; and a circuit board connected to the touch sensor to process the radio signal and the touch input. The antenna unit may include: a first conductive oxide film formed on one surface of an electrode film of the touch sensor and having an antenna pattern corresponding to the radio signal; a metal conductive part laminated on the first conductive oxide film and covering the antenna pattern; and a second conductive oxide film configured to cover the metal conductive part.

The same materials as the first conductive oxide film, the metal conductive part, and the second conductive oxide film may be formed to be laminated in the same order as that of the antenna unit on the electrode film of the touch sensor. The metal conductive part may include: a metal conductive layer configured to cover the first conductive oxide film; and a grid having the same repeated patterns on a surface of the metal conductive layer.

To achieve the above objects, there is also provided a method for fabricating a light-transmissive antenna including: coating a first conductive oxide film on a base film made of a light-transmissive material; forming a metal conductive part such that lines of a metal conductor forms a pre-set grid on a surface of the first conductive oxide film; coating a second conductive oxide film to cover the metal conductive part; and etching the first conductive oxide film, the metal conductive part, and the second conductive oxide film to form an antenna pattern corresponding to a particular frequency band.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

The mobile terminal according to exemplary embodiments of the present invention will now be described with reference to the accompanying drawings. In the following description, usage of suffixes such as 'module', 'part' or 'unit' used for referring to elements is given merely to facilitate explanation of the present invention, without having any significant meaning by itself.

The mobile terminal described in the present invention may include mobile phones, smart phones, notebook computers, digital broadcast receivers, PDAs (Personal Digital Assistants), PMPs (Portable Multimedia Player), navigation devices, and the like.

Figure 1:
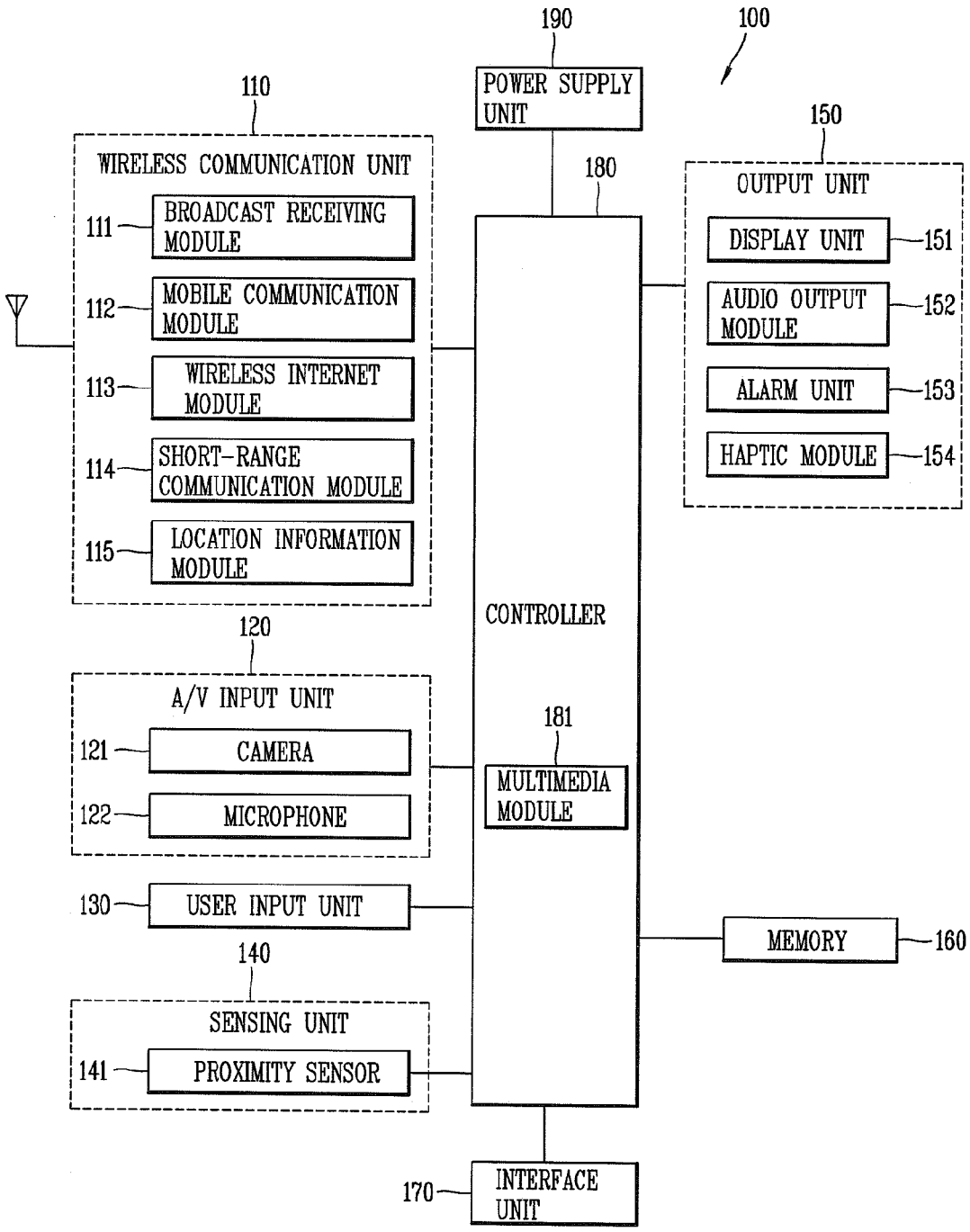
FIG. 1 is a schematic block diagram of a mobile terminal according to an exemplary embodiment of the present invention.

FIG. 1 is a block diagram of a mobile terminal according to an embodiment of the present invention.

The mobile terminal 100 may include a wireless communication unit 110, an A/V (Audio/Video) input unit 120, a user input unit 130, a sensing unit 140, an output unit 150, a memory 160, an interface unit 170, a controller 180, and a power supply unit 190, etc. FIG. 1 shows the mobile terminal as having various components, but it should be understood that implementing all of the illustrated components is not a requirement. Greater or fewer components may alternatively be implemented.

The elements of the mobile terminal will be described in detail as follows.

The wireless communication unit 110 typically includes one or more components allowing radio communication between the mobile terminal 100 and a wireless communication system or a network in which the mobile terminal is located. For example, the wireless communication unit may include at least one of a broadcast receiving module 111, a mobile communication module 112, a wireless Internet module 113, a short-range communication module 114, and a location information module 115.

The broadcast receiving module 111 receives broadcast signals and/or broadcast associated information from an external broadcast management server (or other network entity) via a broadcast channel. The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal. The broadcast signal may include a TV broadcast signal, a radio broadcast signal, a data broadcast signal, and the like. Also, the broadcast signal may further include a broadcast signal combined with a TV or radio broadcast signal.

The broadcast associated information may refer to information associated with a broadcast channel, a broadcast program or a broadcast service provider. The broadcast associated information may also be provided via a mobile communication network and, in this case, the broadcast associated information may be received by the mobile communication module 112.

The broadcast signal may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may be configured to receive signals broadcast by using various types of broadcast systems. In particular, the broadcast receiving module 111 may receive a digital broadcast by using a digital broadcast system such as multimedia broadcasting-terrestrial (DMB-T), digital multimedia broadcasting-satellite (DMB-S), digital video broadcast-handheld (DVB-H), the data broadcasting system known as media forward link only (MediaFLO®), integrated services digital broadcast-terrestrial (ISDB-T), etc. The broadcast receiving module 111 may be configured to be suitable for every broadcast system that provides a broadcast signal as well as the above-mentioned digital broadcast systems.

Broadcast signals and/or broadcast-associated information received via the broadcast receiving module 111 may be stored in the memory 160 (or anther type of storage medium).

The mobile communication module 112 transmits and/or receives radio signals to and/or from at least one of a base station (e.g., access point, Node B, etc.), an external terminal (e.g., other user devices) and a server (or other network entities). Such radio signals may include a voice call signal, a video call signal or various types of data according to text and/or multimedia message transmission and/or reception.

The wireless Internet module 113 supports wireless Internet access for the mobile terminal. This module may be internally or externally coupled to the terminal. The wireless Internet access technique implemented may include a WLAN (Wireless LAN) (Wi-Fi), Wibro (Wireless broadband), Wimax (World Interoperability for Microwave Access), HSDPA (High Speed Downlink Packet Access), or the like.

The short-range communication module 114 is a module for supporting short range communications. Some examples of short-range communication technology include Bluetooth™, Radio Frequency IDentification (RFID), Infrared Data Association (IrDA), Ultra-WideBand (UWB), ZigBee™, and the like.

The location information module 115 is a module for checking or acquiring a location (or position) of the mobile terminal. A typical example of the location information module is a GPS (Global Positioning System).

With reference to FIG. 1, the A/V input unit 120 is configured to receive an audio or video signal. The A/V input unit 120 may include a camera 121 (or other image capture device) and a microphone 122 (or other sound pick-up device). The camera 121 processes image data of still pictures or video obtained by an image capture device in a video capturing mode or an image capturing mode. The processed image frames may be displayed on a display unit 151 (or other visual output device).

The image frames processed by the camera 121 may be stored in the memory 160 (or other storage medium) or transmitted via the wireless communication unit 110. Two or more cameras 121 may be provided according to the configuration of the mobile terminal.

The microphone 122 may receive sounds (audible data) via a microphone (or the like) in a phone call mode, a recording mode, a voice recognition mode, and the like, and can process such sounds into audio data. The processed audio (voice) data may be converted for output into a format transmittable to a mobile communication base station (or other network entity) via the mobile communication module 112 in case of the phone call mode. The microphone 122 may implement various types of noise canceling (or suppression) algorithms to cancel (or suppress) noise or interference generated in the course of receiving and transmitting audio signals.

The user input unit 130 (or other user input device) may generate input data from commands entered by a user to control various operations of the mobile terminal. The user input unit 130 may include a keypad, a dome switch, a touch pad (e.g., a touch sensitive member that detects changes in resistance, pressure, capacitance, etc. due to being contacted) a jog wheel, a jog switch, and the like.

The sensing unit 140 (or other detection means) detects a current status (or state) of the mobile terminal 100 such as an opened or closed state of the mobile terminal 100, a location of the mobile terminal 100, the presence or absence of user contact with the mobile terminal 100 (i.e., touch inputs), the orientation of the mobile terminal 100, an acceleration or deceleration movement and direction of the mobile terminal 100, etc., and generates commands or signals for controlling the operation of the mobile terminal 100. For example, when the mobile terminal 100 is implemented as a slide type mobile phone, the sensing unit 140 may sense whether the slide phone is opened or closed. In addition, the sensing unit 140 can detect whether or not the power supply unit 190 supplies power or whether or not the interface unit 170 is coupled with an external device. The sensing unit 140 may include a proximity sensor 141.

The output unit 150 is configured to provide outputs in a visual, audible, and/or tactile manner (e.g., audio signal, video signal, alarm signal, vibration signal, etc.). The output unit 150 may include the display unit 151, an audio output module 152, an alarm unit 153, a haptic module 154, and the like.

The display unit 151 may display (output) information processed in the mobile terminal 100. For example, when the mobile terminal 100 is in a phone call mode, the display unit 151 may display a User Interface (UI) or a Graphic User Interface (GUI) associated with a call or other communication (such as text messaging, multimedia file downloading, etc.). When the mobile terminal 100 is in a video call mode or image capturing mode, the display unit 151 may display a captured image and/or received image, a UI or GUI that shows videos or images and functions related thereto, and the like.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like.

Some of them may be configured to be transparent or light-transmissive to allow viewing of the exterior, which may be called transparent displays. A typical transparent display may be, for example, a TOLED (Transparent Organic Light Emitting Diode) display, or the like. Through such configuration, the user can view an object positioned at the rear side of the terminal body through the region occupied by the display unit 151 of the terminal body.

The mobile terminal 100 may include two or more display units (or other display means) according to its particular desired embodiment. For example, a plurality of display units may be separately or integrally disposed on one surface of the mobile terminal, or may be separately disposed on mutually different surfaces.

Meanwhile, when the display unit 151 and a sensor (referred to as a 'touch sensor', hereinafter) for detecting a touch operation are overlaid in a layered manner to form a touch screen, the display unit 151 may function as both an input device and an output device. The touch sensor may have a form of a touch film, a touch sheet, a touch pad, and the like.

The touch sensor may be configured to convert pressure applied to a particular portion of the display unit 151 or a change in the capacitance or the like generated at a particular portion of the display unit 151 into an electrical input signal. The touch sensor may be configured to detect the pressure when a touch is applied, as well as the touched position and area.

When there is a touch input with respect to the touch sensor, a corresponding signal (signals) are transmitted to a touch controller. The touch controller processes the signals and transmits corresponding data to the controller 180. Accordingly, the controller 180 may recognize which portion of the display unit 151 has been touched.

With reference to FIG. 1, a proximity sensor 141 may be disposed within or near the touch screen. The proximity sensor 141 is a sensor for detecting the presence or absence of an object relative to a certain detection surface or an object that exists nearby by using the force of electromagnetism or infrared rays without a physical contact. Thus, the proximity sensor 141 has a considerably longer life span compared with a contact type sensor, and it can be utilized for various purposes.

Examples of the proximity sensor 141 may include a transmission type photoelectric sensor, a direct reflection type photoelectric sensor, a mirror-reflection type photo sensor, an RF oscillation type proximity sensor, a capacitance type proximity sensor, a magnetic proximity sensor, an infrared proximity sensor, and the like. In case where the touch screen is the capacitance type, proximity of the pointer is detected by a change in electric field according to the proximity of the pointer. In this case, the touch screen (touch sensor) may be classified as a proximity sensor.

In the following description, for the sake of brevity, recognition of the pointer positioned to be close to the touch screen will be called a 'proximity touch', while recognition of actual contacting of the pointer on the touch screen will be called a 'contact touch'. In this case, when the pointer is in the state of the proximity touch, it means that the pointer is positioned to correspond vertically to the touch screen.

By employing the proximity sensor 141, a proximity touch and a proximity touch pattern (e.g., a proximity touch distance, a proximity touch speed, a proximity touch time, a proximity touch position, a proximity touch movement state, or the like) can be detected, and information corresponding to the detected proximity touch operation and the proximity touch pattern can be outputted to the touch screen.

The audio output module 152 may convert and output as sound audio data received from the wireless communication unit 110 or stored in the memory 160 in a call signal reception mode, a call mode, a record mode, a voice recognition mode, a broadcast reception mode, and the like. Also, the audio output module 152 may provide audible outputs related to a particular function performed by the mobile terminal 100 (e.g., a call signal reception sound, a message reception sound, etc.). The audio output module 152 may include a speaker, a buzzer, or other sound generating device.

The alarm unit 153 (or other type of user notification means) may provide outputs to inform about the occurrence of an event of the mobile terminal 100. Typical events may include call reception, message reception, key signal inputs, a touch input etc. In addition to audio or video outputs, the alarm unit 153 may provide outputs in a different manner to inform about the occurrence of an event. For example, the alarm unit 153 may provide an output in the form of vibrations (or other tactile or sensible outputs). When a call, a message, or some other incoming communication is received, the alarm unit 153 may provide tactile outputs (i.e., vibrations) to inform the user thereof. By providing such tactile outputs, the user can recognize the occurrence of various events even if his mobile phone is in the user's pocket. Outputs informing about the occurrence of an event may be also provided via the display unit 151 or the audio output module 152. The display unit 151 and the audio output module 152 may be classified as a part of the alarm unit 153.

A haptic module 154 generates various tactile effects the user may feel. A typical example of the tactile effects generated by the haptic module 154 is vibration. The strength and pattern of the haptic module 154 can be controlled. For example, different vibrations may be combined to be outputted or sequentially outputted.

Besides vibration, the haptic module 154 may generate various other tactile effects such as an effect by stimulation such as a pin arrangement vertically moving with respect to a contact skin, a spray force or suction force of air through a jet orifice or a suction opening, a contact on the skin, a contact of an electrode, electrostatic force, etc., an effect by reproducing the sense of cold and warmth using an element that can absorb or generate heat.

The haptic module 154 may be implemented to allow the user to feel a tactile effect through a muscle sensation such as fingers or arm of the user, as well as transferring the tactile effect through a direct contact. Two or more haptic modules 154 may be provided according to the configuration of the mobile terminal 100.

The memory 160 may store software programs used for the processing and controlling operations performed by the controller 180, or may temporarily store data (e.g., a phonebook, messages, still images, video, etc.) that are inputted or outputted. In addition, the memory 160 may store data regarding various patterns of vibrations and audio signals outputted when a touch is inputted to the touch screen.

The memory 160 may include at least one type of storage medium including a Flash memory, a hard disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, and an optical disk. Also, the mobile terminal 100 may be operated in relation to a web storage device that performs the storage function of the memory 160 over the Internet.

The interface unit 170 serves as an interface with every external device connected with the mobile terminal 100. For example, the external devices may transmit data to an external device, receives and transmits power to each element of the mobile terminal 100, or transmits internal data of the mobile terminal 100 to an external device. For example, the interface unit 170 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating the authority of using the mobile terminal 100 and may include a user identity module (UIM), a subscriber identity module (SIM) a universal subscriber identity module (USIM), and the like. In addition, the device having the identification module (referred to as 'identifying device', hereinafter) may take the form of a smart card. Accordingly, the identifying device may be connected with the terminal 100 via a port.

When the mobile terminal 100 is connected with an external cradle, the interface unit 170 may serve as a passage to allow power from the cradle to be supplied therethrough to the mobile terminal 100 or may serve as a passage to allow various command signals inputted by the user from the cradle to be transferred to the mobile terminal therethrough. Various command signals or power inputted from the cradle may operate as signals for recognizing that the mobile terminal is properly mounted on the cradle.

The controller 180 typically controls the general operations of the mobile terminal. For example, the controller 180 performs controlling and processing associated with voice calls, data communications, video calls, and the like. The controller 180 may include a multimedia module 181 for reproducing multimedia data. The multimedia module 181 may be configured within the controller 180 or may be configured to be separated from the controller 180.

The controller 180 may perform a pattern recognition processing to recognize a handwriting input or a picture drawing input performed on the touch screen as characters or images, respectively.

The power supply unit 190 receives external power or internal power and supplies appropriate power required for operating respective elements and components under the control of the controller 180.

Various embodiments described herein may be implemented in a computer-readable or its similar medium using, for example, software, hardware, or any combination thereof.

For hardware implementation, the embodiments described herein may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, electronic units designed to perform the functions described herein. In some cases, such embodiments may be implemented by the controller 180 itself.

For software implementation, the embodiments such as procedures or functions described herein may be implemented by separate software modules. Each software module may perform one or more functions or operations described herein. Software codes can be implemented by a software application written in any suitable programming language. The software codes may be stored in the memory 160 and executed by the controller 180.

Figure 2A:
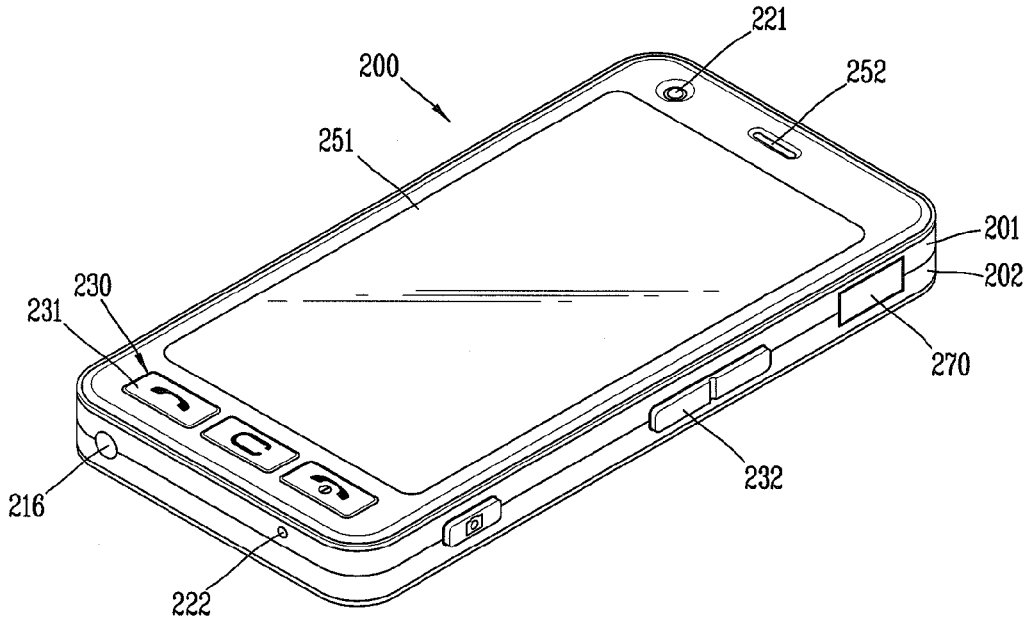
FIG. 2A is a front perspective view of the mobile terminal according to an exemplary embodiment of the present invention.

FIG. 2A is a front perspective view of a mobile terminal implementing an embodiment of the present invention;

The disclosed mobile terminal 200 has a bar type terminal body. However, without being limited thereto, the present invention can be also applicable to a slide type mobile terminal, a folder type mobile terminal, a swing type mobile terminal, a swivel type mobile terminal and the like, including two or more bodies.

The terminal body includes a case (or casing, housing, cover, etc.) constituting the external appearance of the terminal body. In the present exemplary embodiment, the case may be divided into a front case 201 and a rear case 202. Various electronic components are installed in the space between the front case 201 and the rear case 202. One or more intermediate cases may be additionally disposed between the front case 201 and the rear case 202.

The cases may be formed by injection-molding a synthetic resin or may be made of a metallic material such as stainless steel (STS) or titanium (Ti), etc.

The display unit 251, the audio output module 252, camera 221, and the user input unit 230 (231, 232), the microphone 222, the interface unit 270, and the like, may be located on the terminal body, namely, mainly, on the front case 201.

The display unit 251 occupies the most portion of the front surface of the front case 201. The audio output unit 251 and the camera 221 are disposed at a region adjacent to one of both end portions of the display unit 251, and the user input unit 231 and the microphone 222 are disposed at a region adjacent to another of the both end portions. The user input unit 232, the interface 270, and the like, may be disposed at the sides of the front case 201 and the rear case 202.

The user input unit 230 is manipulated to receive commands for controlling the operation of the mobile terminal 200, and may include a plurality of manipulation units 231 and 232. The manipulation units 231 and 232 may be generally called a manipulating portion, and they can employ any method so long as they can be manipulated in a tactile manner by the user.

Content inputted by the first and second manipulation units 231 and 232 may be variably set. For example, the first manipulation unit 231 receives commands such as start, end, scroll, or the like, and the second manipulation unit 232 may receive commands such as adjustment of size of a sound outputted from the audio output unit 252 or conversion to a touch recognition mode of the display unit 251. The display unit 251 constitutes a touch screen along with the touch sensor 240 (See FIG. 3), and the touch screen may be an example of the user input unit 230.

Figure 2B:
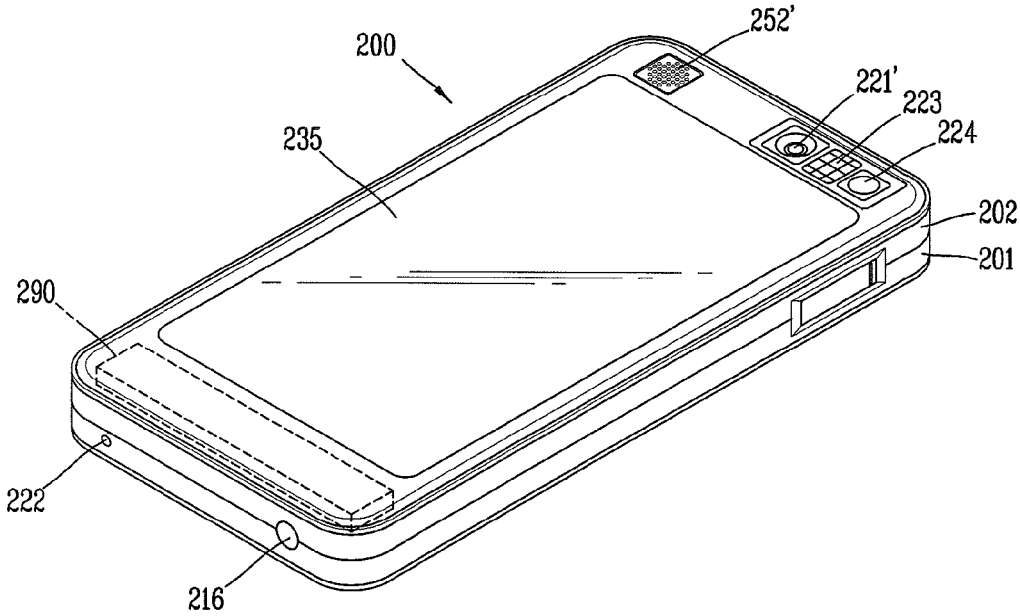
FIG. 2B is a rear perspective view of the mobile terminal illustrated in FIG. 2A.

FIG. 2B is a rear perspective view of the mobile terminal illustrated in FIG. 2A according to an exemplary embodiment of the present invention.

With reference to FIG. 2B, a camera 221' may additionally be disposed on a rear surface of the terminal body, namely, on the rear case 202. The camera 221' may have an image capture direction which is substantially opposite to that of the camera 221 (See FIG. 2A), and may support a different number of pixels (i.e., have a different resolution) than the camera 221.

For example, camera 221 may operate with a relatively lower resolution to capture an image(s) of the user's face and immediately transmit such image(s) to another party in real-time during video call communication or the like. Meanwhile the camera 221' may operate with a relatively higher resolution to capture images of general objects with high picture quality, which may not require immediately transmission in real time. The cameras 221 and 221' may be installed on the terminal such that they are rotated or popped up.

A flash 223 and a mirror 224, may be additionally disposed adjacent to the camera 221'. When an image of the subject is captured with the camera 221', the flash 223 illuminates the subject. The mirror 224 allows the user to see himself when he wants to capture his own image (i.e., self-image capturing) by using the camera 221'.

An audio output unit 252' may be additionally disposed on the rear surface of the terminal body. The audio output unit 252' may implement a stereoscopic function along with the audio output unit 252 (See FIG. 2A), and may be used for implementing a speaker phone mode during call communication.

A broadcast signal receiving antenna 216 may be disposed at the side of the terminal body in addition to an antenna that supports mobile communications. The antenna 216 forming a portion of the broadcast reception module 111 (in FIG. 1) may be installed to be protracted.

A power supply unit 290 for supplying power to the mobile terminal 200 may be mounted on the terminal body in order to supply power to the mobile terminal 200. The power supply unit 290 may be installed in the terminal body or may be directly detached from the outside of the terminal body.

A touch sensor 235 may be additionally mounted to detect a touch. The touch sensor 235 may be configured to be light-transmissive like the display unit 251. In this case, when the display unit 251 is configured to output visual information from both sides, the visual information can be recognized also through the touch sensor 235. The information outputted from both sides can be controlled by the touch sensor 235. Alternatively, a display may be additionally mounted on the touch sensor 235, so a touch screen may be disposed on the rear case 202.

The touch sensor 235 is operated in relation to the display unit 251 of the front case 201. The touch sensor 235 may be disposed to be parallel to the rear side of the display unit 251. The touch sensor 235 may have a size which is the same as or smaller than the display unit 251.

The mobile terminal according to an exemplary embodiment of the present invention includes a light-transmissive antenna unit 210 mounted on a terminal body in order to transmit or receive a radio signal (Here, 'light-transmittance' includes 'complete transmittance' or 'transparency' and 'semi-transmittance' or 'translucency'). For example, the light-transmissive antenna unit 210 may be integrally formed with the touch sensor 24*o* combined with the display unit 251. The light-transmissive antenna unit 210 will now be described in detail with reference to FIGS. 3 to 5.

Figure 3:
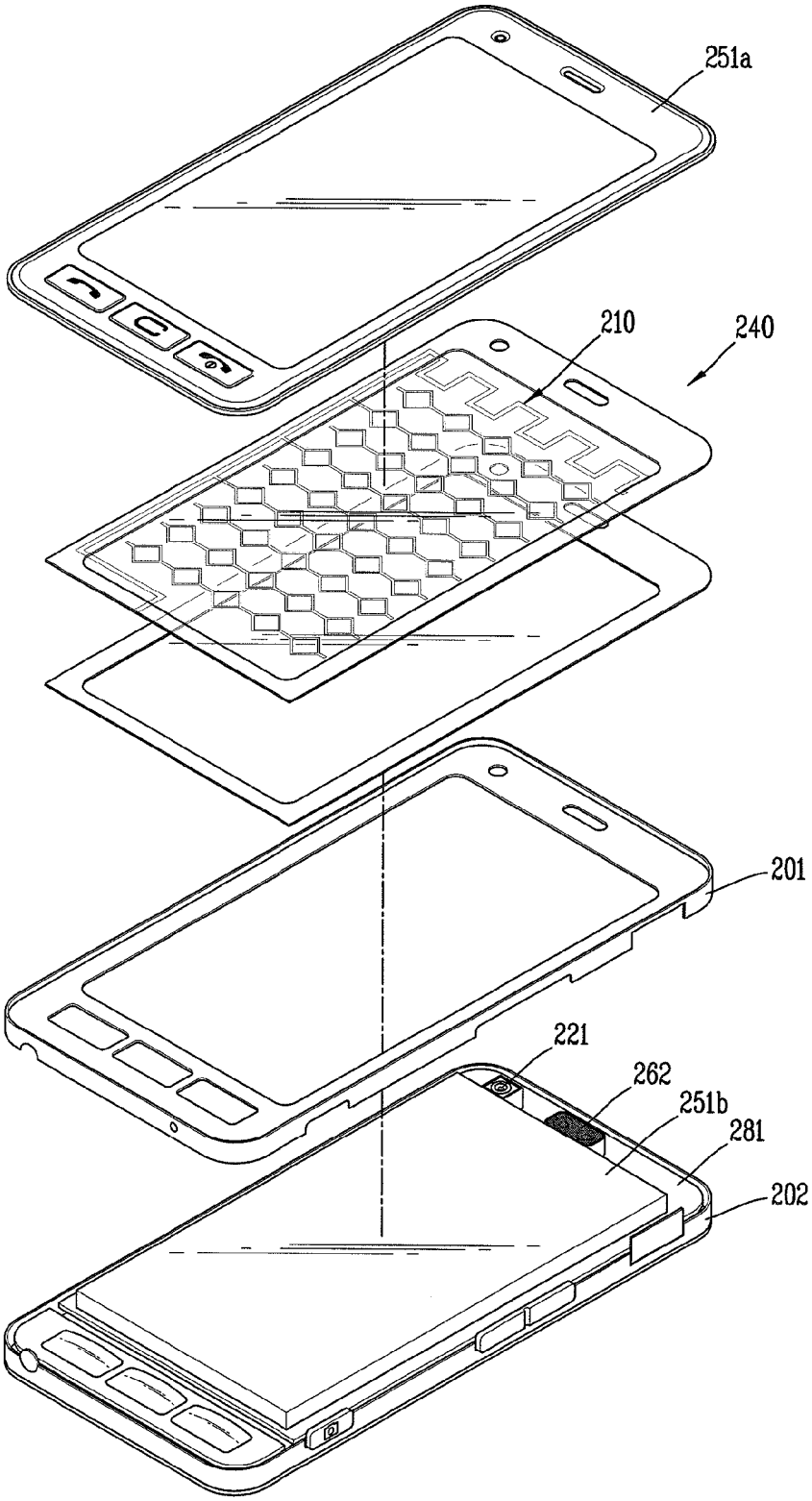
FIG. 3 is an exploded view of the mobile terminal of FIG. 3.
Figure 4:
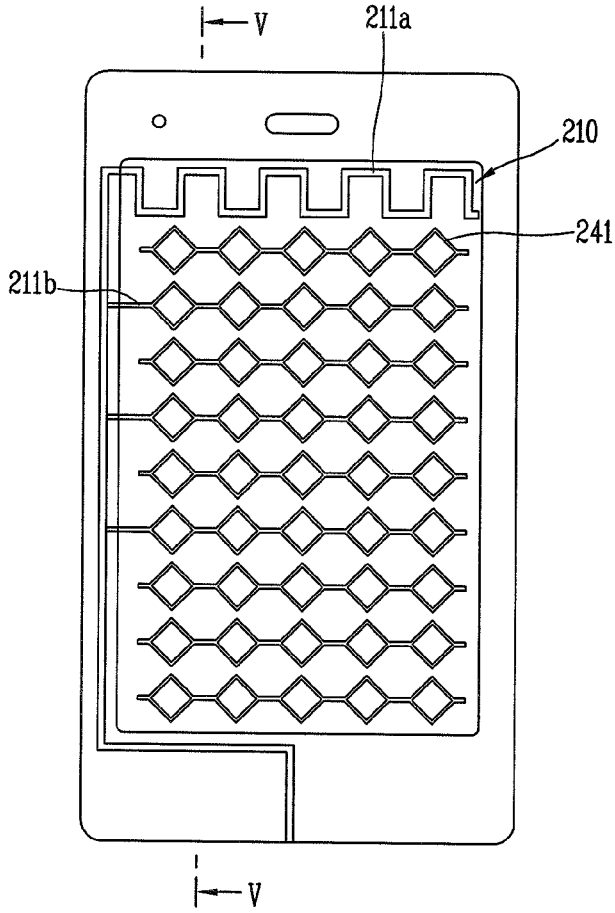
FIG. 4 is an enlarged view of a touch sensor of FIG. 3.
Figure 5:
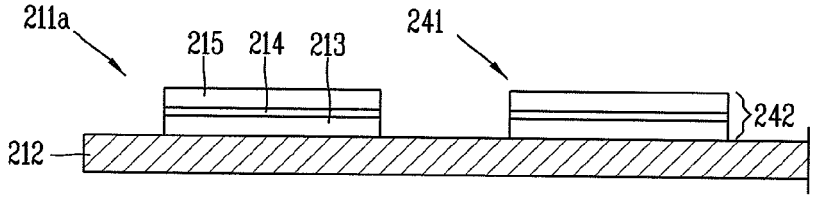
FIG. 5 is a sectional view taken along line V-V in FIG. 4.

FIG. 3 is an exploded view of the mobile terminal of FIG. 3, FIG. 4 is an enlarged view of a touch sensor of FIG. 3, and FIG. 5 is a sectional view taken along line V-V in FIG. 4.

With reference to FIG. 3, a window 251*a* is coupled to one surface of the front case 201. The window 251*a* may be made of a material, for example, a light-transmissive synthetic resin, tempered glass, and the like, allowing light to be transmitted therethrough. The window 251*a* may include a portion not allowing light to be transmitted therethrough.

A display unit 251*b* may be mounted on a rear surface of the window 251*a*. The display 251*b* displays visual information and is disposed to be covered by the window 251*a*. The portion of the window 251*a* allowing light to be transmitted therethrough may have an area corresponding to the display 251*b*. Accordingly, the user can recognize the visual information outputted from the display unit 251*b* to the outside.

A circuit board 281 may be mounted on the rear case 202. The circuit board 281 may be configured as an example of the controller 180 (See FIG. 1) for operating various functions of the mobile terminal. As shown, an audio output module 262, the camera 221, and the like, may be mounted on the circuit board 281. The audio output module 262 may be, for example, a speaker, a speaker, and the like.

As illustrated in FIG. 3, a touch sensor 240 may be mounted on the window 251*a*.

The touch sensor 240 may be mounted on an upper or lower surface of the window 251*a*. A portion of the window 251*a* allowing light to be transmitted therethrough forms an area allowing for inputting through the touch sensor 240. The touch sensor 240 is made of a light-transmissive material and may be configured to convert a change in a voltage, capacitance, and the like, generated from a particular portion of the window 251*a* into an electrical input signal.

An antenna unit 210 is formed on the touch sensor 240 to transmit and receive a radio signal. The touch sensor 240 may be connected to the circuit board 281 to process a radio signal and a touch input. However, the present invention is not necessarily limited thereto, and each circuit board may process a radio signal and a touch input.

With reference to FIG. 4, the antenna unit 210 includes an antenna pattern 211*a* formed on one surface of the touch sensor. The antenna pattern 211*a* may have a length or shape corresponding to a particular frequency band and fed and grounded to the circuit board 281 (See FIG. 3). For example, the circuit board 281 is disposed to be in electrically directly contact with the antenna pattern 211*a* or spaced apart by an interval of 0.01λ or below from the antenna pattern 211*a* on the basis of a free space wavelength so as to be electromagnetically indirectly fed.

With reference to FIG. 5, the antenna unit 210 includes a base film 212, a first conductive oxide film 213, a metal conductive part 214, and a second conductive oxide film 215.

The base film 212 is made of a light-transmissive material, and may become a light-transmissive electrode film of the touch sensor 210. For example, the touch sensor 210 may have a plurality of electrode films configured to detect coordinates in X and Y directions, and the base film 212 may be one of the plurality of electrode films.

The first conductive oxide film 213 is formed on one surface of the base film 212. For example, the first conductive oxide film 213 forms an antenna pattern 211*a* on the surface of the base film 212.

The first conductive oxide film 213 may be made of one oxide among IZO (Zinc doped Indium Oxide), ITO (Tin doped Indium Oxide), AZO (Aluminum doped Zinc Oxide), GZO (Gallium doped Zinc Oxide), ZTO Zinc oxide), AZTO (Aluminum, Tin doped Zinc Oxide), $TiO_2$, IAZTO (Aluminum, Zinc, Tin doped Indium Oxide), IZTO (Zinc, Tin doped Indium Oxide), and $SiO_2$, and coated on the base film 212 through sputtering or the like.

The metal conductive part 214 is laminated on the first conductive oxide film 213 and covers the antenna pattern 211*a*. However, the present invention is not necessarily limited thereto, and the first conductive oxide film 213 may not form the antenna pattern 211*a* of the antenna unit, and only the metal conductive part 214 may form the antenna pattern 211*a*.

The metal conductive part 214 may be formed of a metal conductor printed or deposited on the first conductive oxide film 213. The metal conductor may be made of one of silver (Ag), copper (Cu), gold (Au), molybdenum (Mo), and aluminum (Al).

The second conductive oxide film 215 is formed to cover the metal conductive part 214. For example, the second conductive oxide film 215 is coated on the metal conductive part 214 by using the same material through sputtering or the like. The first and second conductive oxide films 215 may have the same or similar thickness, and in this case, the thickness may be 40 nanometers. The metal conductive part 214 may be formed to be thinner than the first and second conductive oxide films 215. For example, the metal conductive part 214 may have a thickness of about 10 nanometers to 15 nanometers.

The first conductive oxide film 213, the metal conductive part 214, and the second conductive oxide film 215 may be laminated as one of combinations of IZO/(Ag,Cu,Au)/IZO, ITO/(Ag,Cu,Au)/ITO, AZO/(Ag,Cu,Au)/AZO, GZO/(Ag,Cu,Au)/GZO, ZTO(Tin oxide 1:1)/(Ag,Cu,Au)/ZTO, AZTO/

(Ag,Cu,Au)/AZTO, $TiO_2$/(Ag,Cu,Al,Au)/$TiO_2$, IAZTO/(Ag,Cu,Al,Au)/IAZTO, IZTO/(Ag,Cu,Au,Mo)/IZTO and SiO2/(Ag,Cu,Al,Au,Mo)/$SiO_2$.

The laminated structure (referred to as an 'OMO structure', hereinafter) of the first conductive oxide film 213, the metal conductive part 214, and the second conductive oxide film 215 implements a light-transmissive antenna having low resistance and high transmittance by using high transmittance of the oxide and low resistance of the metal.

The reason of exhibiting the high transmittance in spited of the presence of opaque metal in the OMO structure can be explained by an antireflection effect. The antireflection effect is a phenomenon occurring when metal is inserted between a dielectric material or oxide. Namely, it refers to a phenomenon that two materials cause a destructive interference with each other under specific conditions to make reflectivity close to zero in the overall structure.

Having the OMO structure, the antenna unit 210 has light transmittance and can be integrally formed with the touch sensor 240.

With reference to FIGS. 4 and 5, the touch sensor 240 includes at least one electrode layer 242 forming a touch pattern 241 on the base film 212 to detect a touched point.

In detail, the electrode layer 242 constitutes the electrode film of the touch sensor along with the base film 212, and is formed by laminating the same materials as the first conductive oxide film 213, the metal conductive part 214, and the second conductive oxide 215 in the same manner as that of the antenna unit 210. Accordingly, the antenna pattern 211*a* and the touch pattern 241 may be formed simultaneously through a single process. The fabrication process may be performed by laminating the first conductive oxide film 213, the metal conductive part 214, and the second conductive oxide film 215 on the base film, performing masking, etching a photosensitive material, and then etching the OMO structure.

With reference to FIG. 4, a second antenna pattern 211*b* corresponding to a frequency band different from that of the antenna pattern 211*a* may be formed on the touch sensor 240. As illustrated, at least a portion of the touch pattern 241 forms the second antenna pattern 211*b*. For example, conductive lines of the touch pattern 241 forms a plurality of touch areas, and a portion of the conductive lines may be the second antenna pattern 211*b*. Accordingly, the size of the touch sensor 240 integrated with the antenna unit 210 can be reduced.

When the metal conductor have a certain thickness or greater, the range of a change in a specific resistance and surface resistance is reduced, and when the thickness of the metal conductive increases to a bulk limit, the specific resistance qualities of the metal can be implemented. In this case, however, the antireflection phenomenon disappears, making the antenna unit 210 opaque. Thus, if the resistance can be reduced without increasing the thickness of the metal conductor, the antenna unit having superior antenna performance and maintaining light transmittance could be implemented.

Figure 6A:
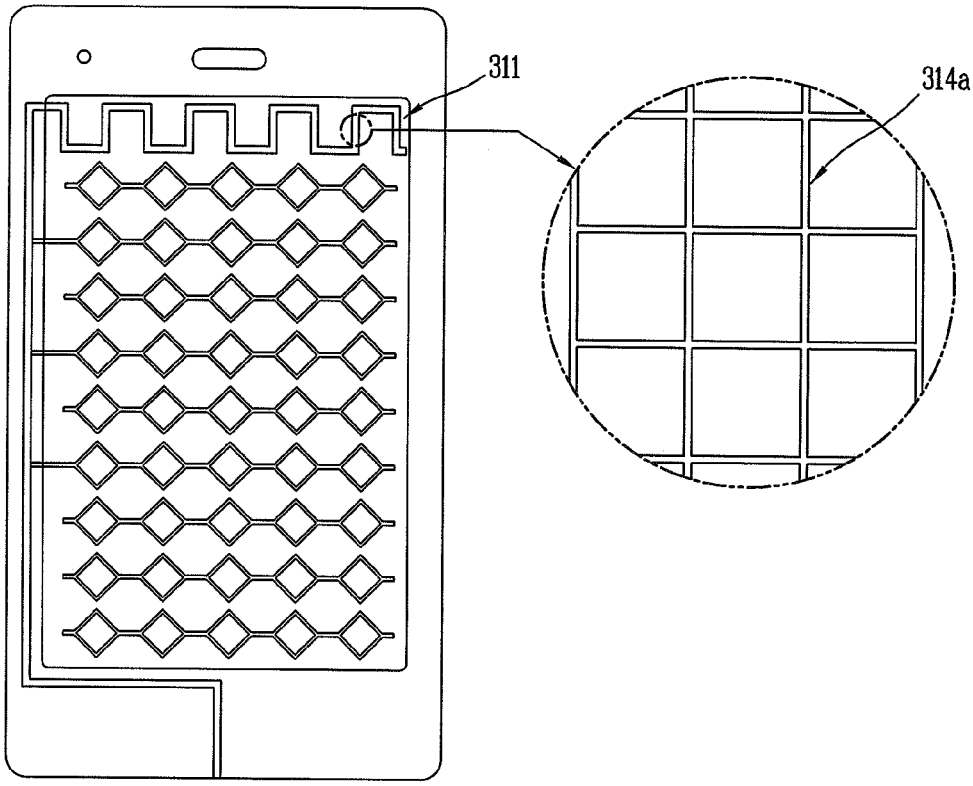
FIGS. 6A and 6B are an enlarged view and a sectional view showing an antenna unit according to another exemplary embodiment of the present invention.
Figure 6B:
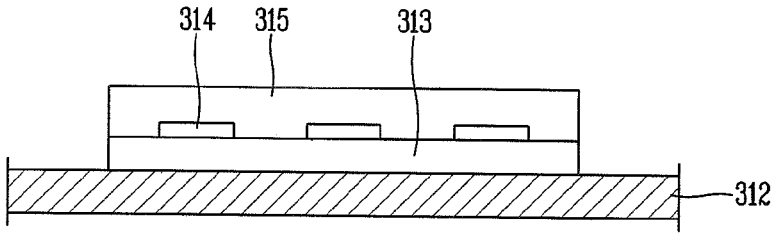
Figure 7A:
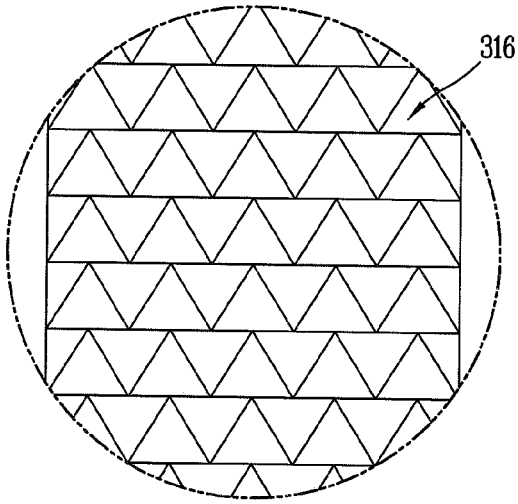
FIGS. 7A to 7C are conceptual views showing modifications of a grid illustrated in FIG. 6A.
Figure 7B:
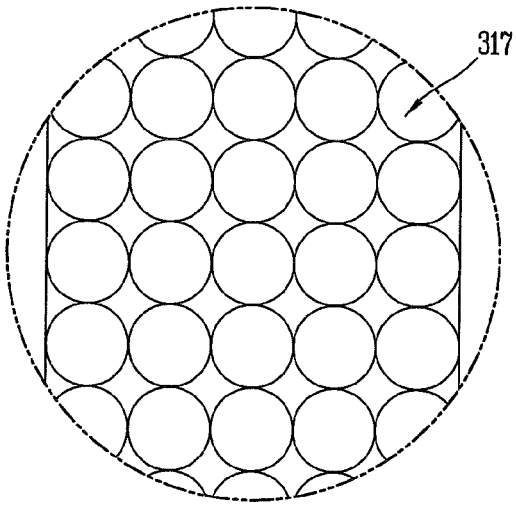
Figure 7C:
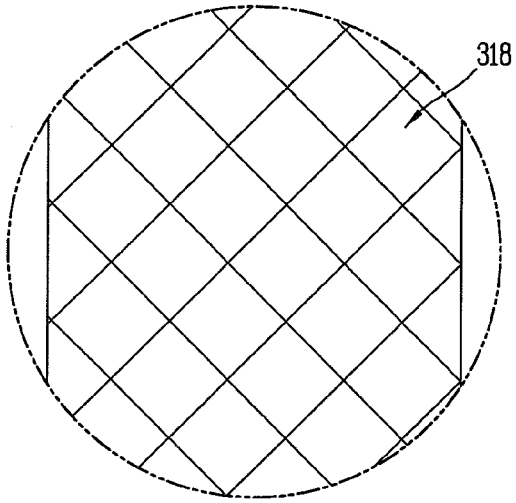

A light-transmissive antenna unit having excellent antenna performance according to another exemplary embodiment of the present invention will now be described. FIGS. 6A and 6B are an enlarged view and a sectional view showing an antenna unit according to another exemplary embodiment of the present invention, and FIGS. 7A to 7C are conceptual views showing modifications of a grid illustrated in FIG. 6A.

With reference to FIGS. 6A and 6B, a metal conductive part 314 forms a grid in the interior of the antenna pattern 311. In detail, a plurality of lines 314*a* formed by the metal conductor are disposed on the surface of the first conductive oxide film 313, and in this case, the lines 314*a* cross each other to form the grid.

The grid fills the antenna pattern 311, and the pattern formed by the plurality of lines 314*a* may be repeated. The pattern may be, for example, a quadrangular pattern.

The width of each of the lines 314*a* may be about 20 micrometers, and the distance between the lines 314*a* may be about 300 micrometers. With this dimension, the antenna unit can exhibit excellent antenna performance according to experimentation. Also, according to experimentation, the antenna unit with the grid exhibited a resistance value ranging from 10-6 ohm-cm, while a resistance value of an antenna unit without a grid is approximately 10-5 ohm-cm. Because the resistance is lowered, the transmission and reception performance of the antenna can be further improved.

With reference to FIGS. 7A to 7C, the grid may be modified in various forms. For example, the grid may include a triangular grid 316, a circular grid 317, and a diamond-like grid 318.

Figure 8A:
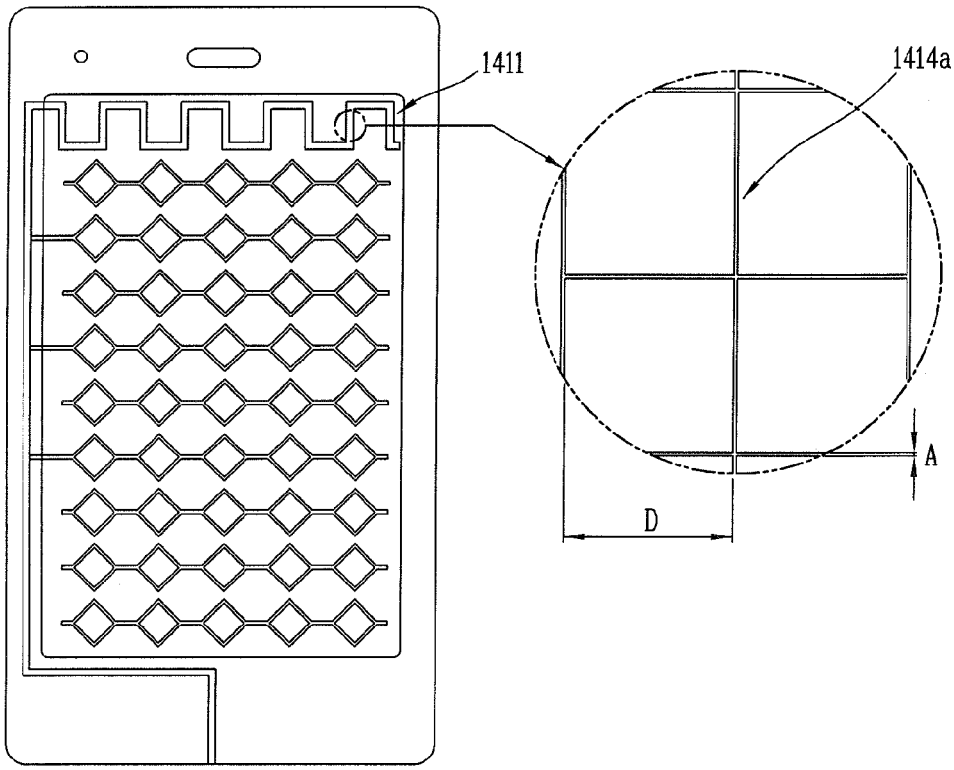
FIGS. 8A and 8B are an enlarged view and a sectional view showing an antenna unit according to another exemplary embodiment of the present invention.
Figure 8B:
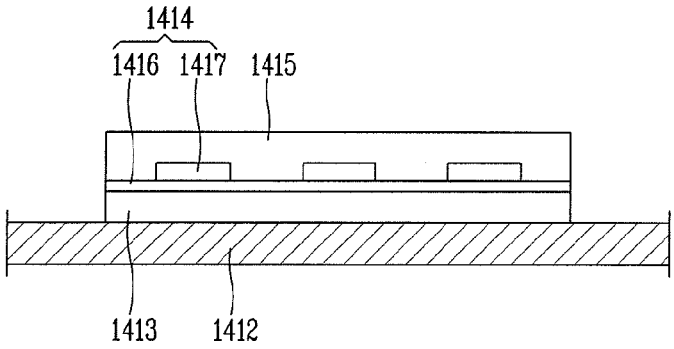
Figure 9:
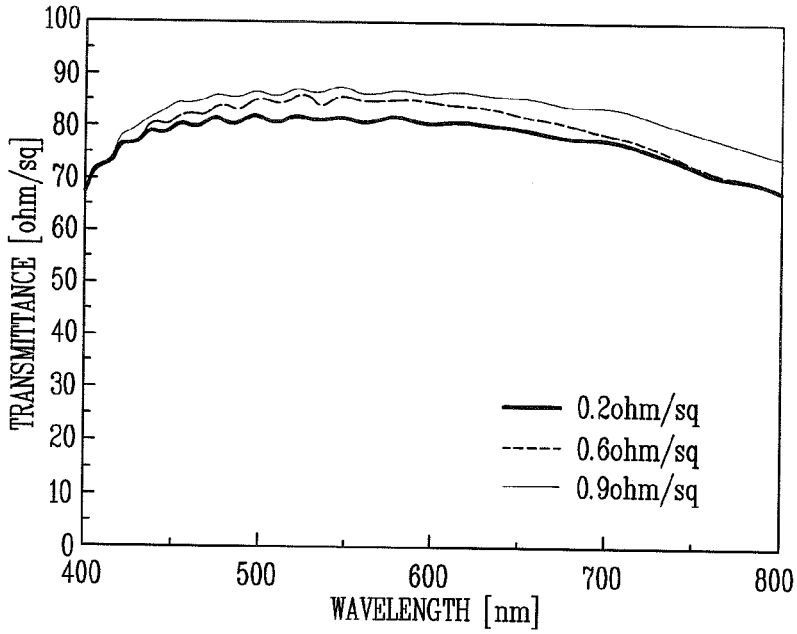
FIG. 9 is a graph showing the performance of the antenna unit of FIG. 8.

FIGS. 8A and 8B are an enlarged view and a sectional view showing an antenna unit according to another exemplary embodiment of the present invention, and FIG. 9 is a graph showing the performance of the antenna unit of FIG. 8.

With reference to FIGS. 8A and 8B, a metal conductive part 1414 includes a metal conductive layer 1416 and a grid layer 1417.

The metal conductive layer 1416 is configured to cover the first conductive oxide film 1413. The metal conductive layer 1416 may be formed, for example, by depositing a metal conductor on the surface of the first conductive oxide film through sputtering or the like.

The grid layer 1417 is formed on the surface of the metal conductive layer 1416, and metal conductor is repeated with the same pattern to form the grid. In detail, the metal conductor is deposited or printed as a plurality of lines on the surface of the metal conductive layer 1416, and the plurality of lines form the grid on the surface of the metal conductive layer 1416.

The metal conductive layer 1416 is formed to have a thickness smaller than the grid layer 1417. Although the width (A) of the lines 1414*a* is small and the distance (D) between the lines 1414*a* are large, the metal conductive part 1414 can maintain a low resistance value by the metal conductive layer 1416. In addition, because the width (A) of the lines 1414*a* and the distance (D) between the lines 1414*a* is large, light transmittance can be improved.

With reference to the graph of FIG. 9, the grid layer 1417 may be configured such that width of the lines 1414*a* ranges from 10 micrometers to 20 micrometers and the distance between the adjacent lines 1414*a* ranges from 1400 micrometers to 600 micrometers.

The width of the lines 1414*a* is about 15 micrometers and the thickness of the lines 1414*a* is about 12 nanometers in each case. With reference to the graph, when the distances between the lines 1414*a* are 500, 750, and 100 micrometers, surface resistance values are 0.2 ohm/sq, 0.5 ohm/sq, and 0.9 ohm/sq, respectively.

The surface resistance value of 0.5 ohm/sq is a resistance value nearly close to metal goods, and thus, when the distance between the adjacent lines 1414*a* is about 500 micrometers, good antenna characteristics can be obtained. In addition, transmittance at a visible ray area is 80% or greater, obtaining transparency characteristics in each case.

Figure 10:
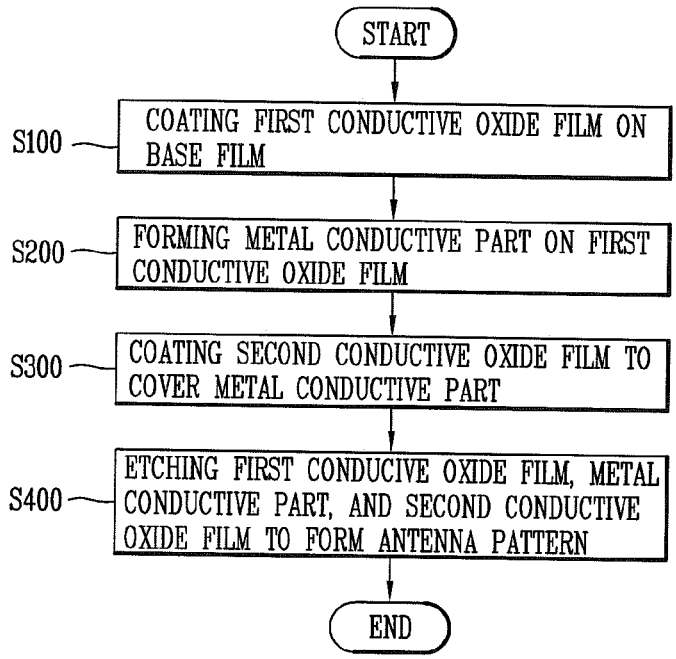
FIG. 10 is a flow chart illustrating the process of a method for fabricating a light-transmissive antenna unit according to an exemplary embodiment of the present invention.

A method for fabricating an antenna that can be applicable to the antenna unit will now be described. FIG. 10 is a flow chart illustrating the process of a method for fabricating a light-transmissive antenna unit according to an exemplary embodiment of the present invention.

First, a first conductive oxide film is coated on a base film made of a light-transmissive material (S100). The base film may be formed as a thin film by using at least of materials among glass, quartz, a synthetic resin, and a polymer material.

The coating may be performed by using, for example, a chemical vapor deposition (CVD), a physical vapor deposition (PVD), an nk-Jet, gravure printing, spin coating, and the like. Also, the coating may be performed in a roll-to-roll manner in which a dry method and a wet method continue.

A metal conductive part, on which lines of a metal conductor form a grid, is formed on the surface of the conductive oxide film (S200).

The metal conductive part may be made as the grid disposed on the surface of the conductive oxide film or may be as a grid disposed on the surface of the metal conductive layer formed on the conductive oxide film. The metal conductive part may be formed through sputtering or printing.

A second conductive oxide film is coated to cover the metal conductive part (S300). In this case, the coating of the second conductive oxide film may be performed by using the same material as that of the first conductive oxide film through the same method.

Finally, the first conductive oxide film, the metal conductive part, and the second conductive oxide film are etched to form an antenna pattern corresponding to a particular frequency band (S400).

The etching step S400 may be performed in the following order.

An electrode material is deposited on the base film having the first conductive oxide film, the metal conductive part, and the second conductive oxide film laminated thereon, and a photosensitive material is coated thereon. Next, the resultant structure is masked to correspond to the antenna pattern and the photosensitive material is etched. In this case, when a touch pattern is masked together, the touch pattern and the antenna pattern can be formed on the same film. Finally, the laminated structure including the first conductive oxide film, the metal conductive part, and the second conductive oxide film is etched and the photosensitive material is removed.

Various examples of mobile terminals having the light-transmissive antenna will now be described with reference to FIGS. 11A to 14.

Figure 11A:
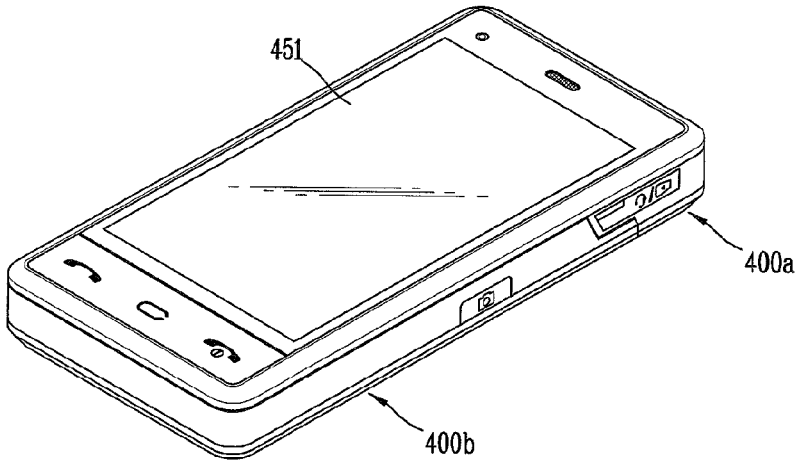
FIGS. 11A and 11B are perspective views showing a closed configuration and an open configuration of a mobile terminal according to another exemplary embodiment of the present invention.
Figure 11B:
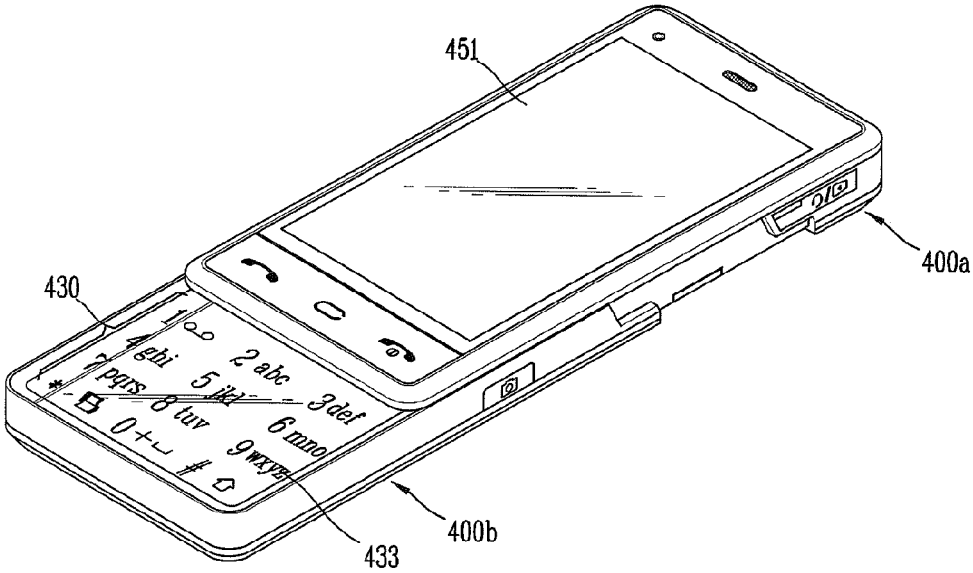
Figure 12:
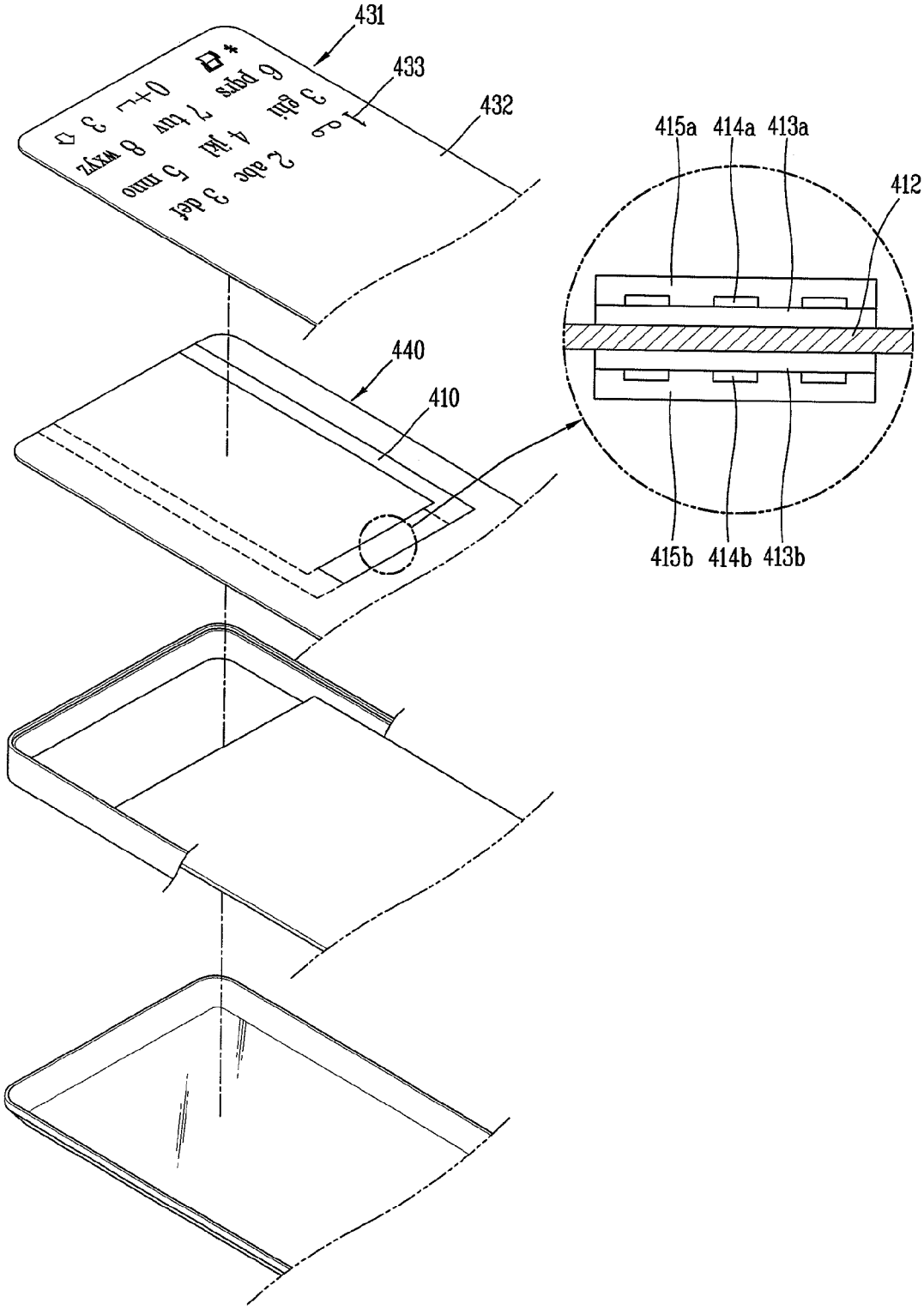
FIG. 12 is an exploded perspective view of a user input unit of FIG. 11B.

FIGS. 11A and 11B are perspective views showing a closed configuration and an open configuration of a mobile terminal according to another exemplary embodiment of the present invention, and FIG. 12 is an exploded perspective view of a user input unit of FIG. 11B.

As shown in FIGS. 11A and 11B, a disclosed mobile terminal 400 includes two bodies 400*a* and 400*b* that can be coupled such that they can be slidable with each other. However, the present invention is not limited thereto and can be applicable to various other structures such as a folder type, a swing type, a swivel type, and the like.

A state in which a portion of the second body 400*b* is exposed toward a front side may be called an open configuration (See FIG. 11B), and a state in which a portion of the second body 400*b* which has been exposed is covered by the first body 400*a* may be called a closed configuration (See FIG. 11A).

According to the present exemplary embodiment, a display unit 451 may be disposed on the first body 400*a*, and a user input unit 430 may be disposed on the second body 400*b*. The user input unit 430 may be covered by the first body 400*a* in the closed configuration.

The second body 400*b* is made of a light-transmissive material, and a touch key pad 431 may be provided on a front surface of the second body 400*b* exposed in the open configuration. With reference the drawing, the touch keypad 431 forms an external appearance of the second body 400*b* and is made of a light-transmissive material.

With reference to FIG. 12, the touch keypad 431 includes a light-transmissive case 432 on which a touch sensor 440 is mounted to receive a control command, and a keypad pattern 433 formed on the case and having numbers, characters, and symbols (will be referred to as 'numbers and so on', hereinafter) corresponding to the control command. The numbers and so on may be formed through printing, carving, or the like, and configured to be discriminated by illumination.

An antenna unit 410 is disposed to overlap with the keypad pattern 433. For example, the antenna unit 410 may be formed on the touch sensor 440, and like the antenna units described above with reference to FIGS. 3 to 9, the antenna unit 410 may be formed by laminating first conducive oxide films 413*a* and 413*b*, metal conductive parts 414*a* and 414*b*, and second conductive oxide films 415*a* and 415*b* on a base film 412.

As illustrated, the antenna unit 410 may include the plurality of the first conducive oxide films 413*a* and 413*b*, the plurality of the metal conductive parts 414*a* and 414*b*, and the plurality of the second conductive oxide films 415*a* and 415*b* which are symmetrically laminated from both sides to receive a radio signal of a multi-frequency band. Accordingly, having the antenna patterns are formed on the sides of the base film 412, the antenna unit 410 which can transmit and receive a radio signal of a multi-frequency band within a limited area can be implemented.

However, the present invention is not limited thereto and the OMO structure may be sequentially laminated on one surface of the base film 412 to receive a radio signal of a multi-frequency band. In this case, because the OMO structure is formed to include multiple layers on one surface of the base film 412, the antenna pattern may be implemented in a three-dimensional form.

Figure 13:
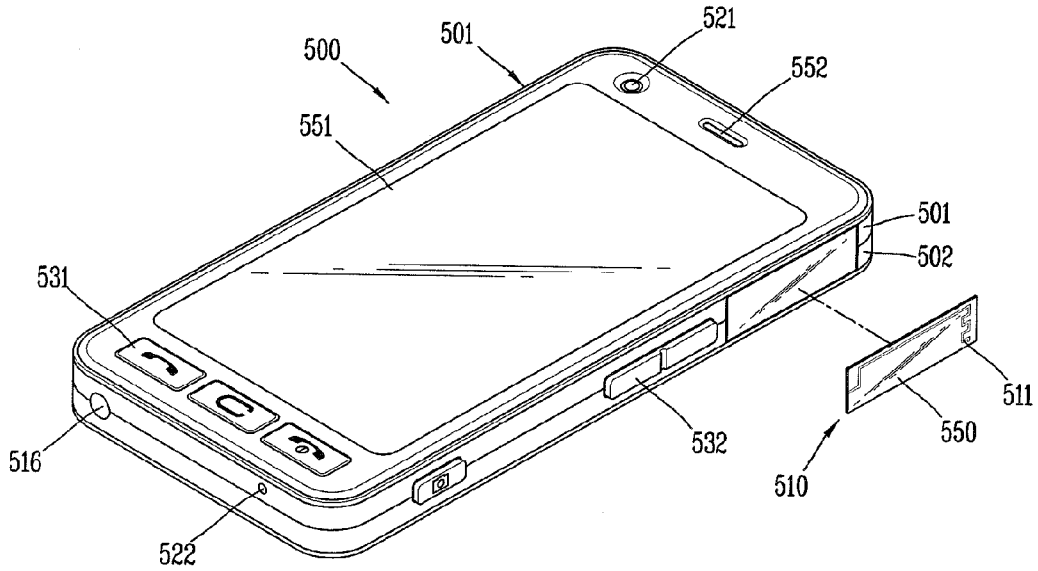
FIGS. 13 and 14 are front perspective views of a mobile terminal according to another exemplary embodiment of the present invention.

FIG. 13 is a front perspective view of a mobile terminal according to another exemplary embodiment of the present invention.

With reference to FIG. 13, a terminal body includes a front portion 501, a rear portion, and a side portion 502. A display unit 551 displaying visual information is formed on the front portion 501, and an antenna unit 510 is disposed on the side portion 502 such that an antenna pattern 511 faces in a crossing direction with respect to the front portion 501.

A user input unit is disposed on the side portion 502, and a touch sensor 550 is provided to detect a touch input. The antenna pattern 511 and the touch pattern are formed to have an OMO structure, and the antenna unit 510 is implemented on the surface of the touch sensor 550.

In this manner, the light-transmissive antenna having the touch pattern is disposed on the side portion of the terminal, so the side-touch structure can be implemented and a radio signal from an area remote from a human body can be transmitted and received.

Figure 14:
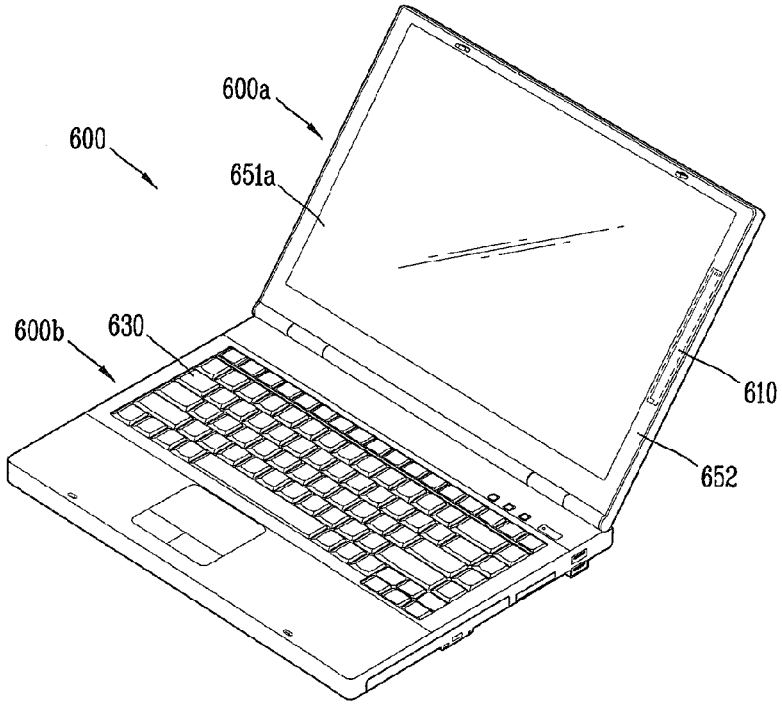

FIG. 14 is a front perspective view of a mobile terminal according to another exemplary embodiment of the present invention.

In the present exemplary embodiment, a notebook computer 600 is disclosed as a mobile terminal. The notebook computer 600 includes two bodies 600*a* and 600*b* which are rotatably coupled. A display unit and a user input unit 630 are disposed on the first and second bodies 600*a* and 600*b*.

As illustrated, a window 651*a* is disposed on the first body 600*a*, and a window bezel 652 made of a light-transmissive material is provided to support the window 651*a*. An antenna unit 610 is mounted on the window bezel 652.

Because the antenna unit 610 is mounted on the window bezel 652, the space taken by the antenna can be reduced, implementing a thinner notebook computer. In addition, a notebook computer of a novel design, different from the conventional notebook computers, can be provided through the light-transmissive window bezel 652 and the antenna unit 610.

As described above, according to exemplary embodiments of the present invention, a light-transmissive antenna having excellent antenna performance can be implemented through the structure obtained by laminating the first conductive oxide film, the metal conductive part, and the second conductive oxide film. Accordingly, the light-transmissive antenna can be integrally formed with the touch sensor.

In addition, because the light-transmissive antenna having the touch pattern is disposed on the side of the terminal, the side touch can be implemented and a signal from a location remote from a human body can be transmitted and received.

Moreover, because the metal conductive part includes the grid layer, the light-transmissive antenna can have a lower surface resistance, and accordingly, the antenna performance can be improved. In addition, because the light-transmissive antenna is mounted on the light-transmissive case, the antenna is not exposed from the light-transmissive mobile terminal.

Furthermore, because the first conductive oxide film, the metal conductive part, and the second conductive oxide film are etched to form the antenna pattern, the light-transmissive antenna can be implemented to have excellent antenna performance and can be implemented through a simpler fabrication method.

As the exemplary embodiments may be implemented in several forms without departing from the characteristics thereof, it should also be understood that the above-described embodiments are not limited by any of the details of the foregoing description, unless otherwise specified, but rather should be construed broadly within its scope as defined in the appended claims. Therefore, various changes and modifications that fall within the scope of the claims, or equivalents of such scope are therefore intended to be embraced by the appended claims.

What is claimed is:

1. A mobile terminal comprising:

a body a touch sensor located on the body and having at least one electrode layer configured to form a touch pattern to detect a touch input on a touched point;

an antenna unit located on the touch sensor, connected to the at least one electrode layer and configured to transmit and receive a radio signal; and a circuit board connected to the antenna unit and configured to process the touch input and the radio signal, wherein the at least one electrode layer and the antenna unit each comprises:

a base film made of a light-transmissive material;

at least one first conductive oxide film formed on one surface of the base film;

at least one metal conductive portion laminated on the at least one first conductive oxide film to form an antenna pattern corresponding to the radio signal and to form the touch pattern extended from the antenna pattern; and at least one second conductive oxide film configured to cover the at least one metal conductive portion.

2. The mobile terminal of claim 1, wherein the at least one metal conductive portion comprises:

a metal conductive layer configured to cover the first conductive oxide film; and a grid layer including a plurality of lines as a metal conductor, the plurality of lines formed to cross in order to form a grid on a surface of the metal conductive layer.

3. The mobile terminal of claim 2, wherein a width of each of the plurality of lines is 10 micrometers to 20 micrometers; and a distance between adjacent lines of the plurality of lines is 400 micrometers to 600 micrometers.

4. The mobile terminal of claim 1, wherein:

the at least one first and at least one second conductive oxide film is made of IZO (Zinc doped Indium Oxide), ITO (Tin doped Indium Oxide), AZO (Aluminum doped Zinc Oxide), GZO (Gallium doped Zinc Oxide), ZTO Zinc oxide), AZTO (Aluminum, Tin doped Zinc Oxide), $TiO_2$, IAZTO (Aluminum, Zinc, Tin doped Indium Oxide), IZTO (Zinc, Tin doped Indium Oxide), or $SiO_2$; and the at least one metal conductive portion is silver (Ag), copper (Cu), gold (Au), molybdenum (Mo), or aluminum (Al).

5. The mobile terminal of claim 1, wherein the antenna unit further comprises a plurality of first conductive oxide films, a plurality of metal conductive portions and a plurality of second conductive oxide films; and the plurality of second conductive oxide films are symmetrically laminated on both surfaces of the base film in order to receive radio signals of a plurality of frequency bands.

6. The mobile terminal of claim 1, wherein the antenna unit further comprises a plurality of first conductive oxide films, a plurality of metal conductive portions and a plurality of second conductive oxide films; and the plurality of second conductive oxide films are sequentially laminated on one surface of the base film.

7. The mobile terminal of claim 1, wherein the at least one metal conductive portion of the antenna unit is laminated on a surface of the at least one first conductive oxide film and comprises a metal conductor forming a grid in an interior of the antenna pattern.

8. The mobile terminal of claim 1, further comprising:

a window mounted on the body and laminated with the touch sensor; and a display configured to display visual information and located such that the display is covered by the window.

9. The mobile terminal of claim 1, further comprising a user input unit configured to receive inputs and comprising a case of the body that is made of a light-transmissive material;

the touch sensor mounted on the case and further configured to receive a control command; and a keypad pattern formed on the case and including numbers, characters, and symbols corresponding to the control command.

10. The mobile terminal of claim 9, wherein the antenna unit overlaps the keypad pattern.

11. The mobile terminal of claim 9, wherein:

the body comprises first and second bodies coupled to be movable between a closed configuration and an open configuration; and the user input unit is formed on one of the first body and second body and covered by the other of the first body and second body in the closed configuration.

12. The mobile terminal of claim 1, wherein:

the body comprises a front surface portion, a rear surface portion, and a side surface portion;

the front surface portion comprises a display unit configured to display visual information; and the antenna unit and the touch sensor are located on the side surface portion such that the antenna pattern faces a direction crossing the front surface portion.

13. The mobile terminal of claim 12, further comprising a user input unit configured to receive inputs, wherein:

the user input unit is located on the side surface portion and comprises the touch sensor; and the at least one electrode layer comprises at least one electrode forming the touch pattern.

14. The mobile terminal of claim 1, wherein the body comprises:

a window located on one surface of a case of the body; and a window bezel on which the antenna unit is mounted, the window bezel made of a light-transmissive material and mounted on the case to support the window.

15. The mobile terminal of claim 1, wherein the at least one first conductive oxide film, the at least one metal conductive portion and the at least one second conductive oxide film are laminated sequentially on the base film.

16. A method for fabricating a light-transmissive antenna and a touch sensor, the method comprising:

coating a first conductive oxide film on a base film that is made of a light-transmissive material;

forming a metal conductive portion having lines that form a pre-set grid on a surface of the first conductive oxide film;

coating a second conductive oxide film to cover the metal conductive portion; and etching the first conductive oxide film, the metal conductive portion, and the second conductive oxide film to form an antenna pattern corresponding to a particular frequency band and to form a touch pattern extended from the antenna pattern, wherein the antenna and the touch sensor are connected to each other.

17. The method of claim 16, wherein the first conductive oxide film, the metal conductive portion and the second conductive oxide film are laminated sequentially on the base film.

* * * * *